United States Patent [19]

Besson

[11] 4,413,915

[45] Nov. 8, 1983

[54] WATCH HAVING AN ANALOG DISPLAY AND A DIGITAL DISPLAY

[75] Inventor: René Besson, Neuchatel, Switzerland

[73] Assignee: ETA S.A. Fabriques d'Ebauches ETA 13, Switzerland

[21] Appl. No.: 329,652

[22] Filed: Dec. 11, 1981

[30] Foreign Application Priority Data

Dec. 16, 1980 [CH] Switzerland ..... 9258/80

[51] Int. Cl.[3] ..... G04B 25/00; G04C 19/00

[52] U.S. Cl. ..... 368/71; 368/84; 368/242; 350/334

[58] Field of Search ..... 368/71, 82, 84, 239, 368/242; 350/334, 336-338

[56] References Cited

U.S. PATENT DOCUMENTS

| | | | |
|---|---|---|---|
| 4,250,572 | 2/1981 | Yoshida | 368/71 |
| 4,312,056 | 1/1982 | Mishimura | 368/62 |
| 4,355,380 | 10/1982 | Huguenin et al. | 368/71 |

FOREIGN PATENT DOCUMENTS

| | | |
|---|---|---|
| 1462898 | 1/1977 | United Kingdom . |
| 2023887 | 2/1979 | United Kingdom . |

*Primary Examiner*—Vit W. Miska

*Attorney, Agent, or Firm*—Allegretti, Newitt, Witcoff & McAndrews, Ltd.

[57] ABSTRACT

A watch which comprises movable analog display members, a dial and a digital display cell surrounded by said dial. The watch is further provided with means that can be controlled by the user of the watch, for making the digital display device visible or invisible, as desired.

The digital display cell is of the twist nematic type.

A liquid crystal layer 60*a* is positioned between two polarizers 60*b* and 60*c*. Polarizer 60*c* can be rotated about an axis 12 perpendicular to its plane by actuating means 13*a*, 14, 15, 17 which is accessible from the outside of the casing of the watch. The cell can be made substantially invisible by rotating the movable polarizer 60*b* in order to position its polarizing plane either parallel or perpendicular to the polarizing plane of the other polarizer 60*c*, depending on whether the color of the dial around the cell is dark or light respectively. Other optical arrangements are disclosed for causing the display device to take selectively the color of the dial and a second color different from the dial's color.

13 Claims, 11 Drawing Figures

WATCH HAVING AN ANALOG DISPLAY AND A DIGITAL DISPLAY

BACKGROUND OF THE INVENTION

1. Field of the Invention

The present invention concerns watches and more particularly watches which are provided both with analog display members, such as hands, which are movable with respect to a dial, and a digital display means such as a liquid crystal cell, surrounded by said dial.

In certain watch designs of this type, the digital display means is of aesthetically unattractive appearance. The main object of the invention is to improve the aesthetic quality of watches of this type.

The invention also seeks to propose a watch of this type, wherein the digital display means is so arranged that it can be rendered either quite visible or substantially invisible in response to a suitable action operated by the user of the watch.

SUMMARY OF THE INVENTION

In accordance with the invention, there is provided a watch comprising a casing, movable members for displaying time analogically, dial means for said movable members, said dial means presenting one colour, and a digital display means surrounded by said dial means and responding to a first external action by taking substantially said one colour, and to a second external action by taking a colour different from said one colour.

Thus, by the performing of the second external action, the digital display means is rendered quite visible so that the digital information appearing on it is rendered more readable.

In accordance with a preferred embodiment of the invention, the digital display means comprises a liquid crystal cell of "twist nematic" type, i.e. a cell which comprises a nematic liquid crystal layer of spiral structure, which is disposed between two polarisers (such as the display means disclosed in U.S. Pat. No. 3,918,769) and wherein one of the polarisers can be rotated about an axis perpendicular to the plane thereof by actuating means which is accessible from the outside of the casing of the watch. The above-mentioned cell can be made substantially invisible by rotating the movable polariser in such a way as to position its polarising plane either parallel or perpendicular to the polarising plane of the other polariser, depending on wether the colour of the dial surrounding the cell is dark or light.

Thus, when the above-mentioned dial is light in colour, the polarising planes of the two polarisers are oriented orthogonally with respect to each other so that the bottom or background of the liquid crystal cell is light in colour. In contrast, if the dial is dark in colour, the above-mentioned polarising planes are oriented parallel to each other so that the bottom or background of the cell is dark in colour. In addition, the watch is provided with means for interrupting the electrical power supply of the cell when the polarising plane of the movable polariser is suitably oriented for the bottom or background of the cell to be of the same colour as the dial.

BRIEF DESCRIPTION OF THE DRAWINGS

The invention will be described in more detail by way of example, with reference to the accompanying drawings, in which.

DETAILED DESCRIPTION

Figure 1:
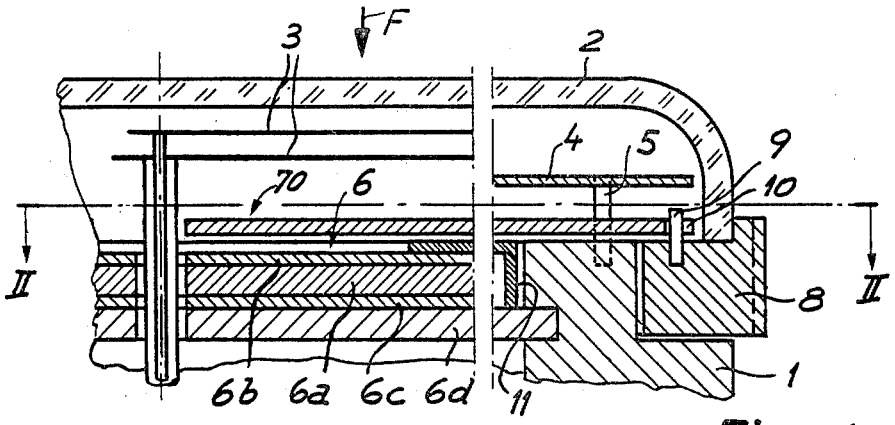
FIG. 1 is a view of part of a first embodiment of the invention, in elevation and vertical section taken along line I—I in FIG. 2.
Figure 2:
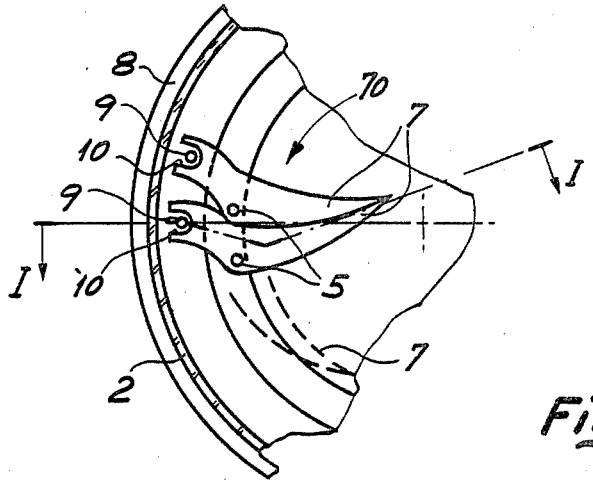
FIG. 2 is a plan view of part of the embodiment, from the plane II—II in FIG. 1.
Figure 3:
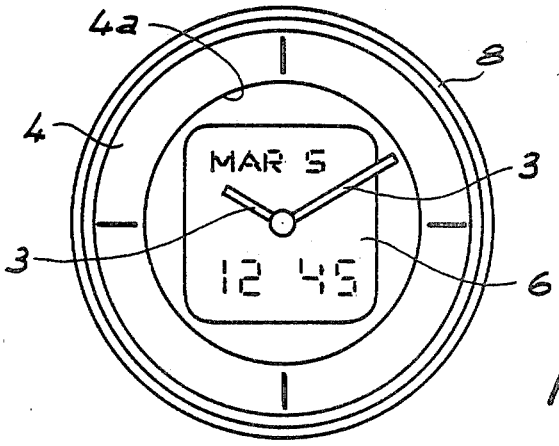
FIG. 3 is a plan view along arrow F in FIG. 1.

In the embodiment shown in FIGS. 1 to 3, the watch comprises a casing body 1 which is closed by a glass 2. The watch comprises analog time display means formed by hands 3 which move with respect to a dial formed by a flat disc 4 which is secured to the casing body 1 by means of vertical pins 5.

The watch further comprises digital display means which is formed for example by a cell 6 of "twist nematic" type i.e. a cell having a nematic liquid crystal layer which has a spiral structure in the unactivated state. In the present example, the nematic liquid crystal of the layer has a positive dielectric anisotropy and the spiral structure of this layer has a 90° twist angle. In plan view, the cell is of substantially square shape, extending within an opening 4*a* of the flat dial-forming disc 4.

The digital display cell 6 may be completely concealed by means of an iris diaphragm device 70 of the type known per se in photographic apparatus, and which is formed by a plurality of sickle-shaped blades 7 the upper faces of which have substantially the same colour as that of the upper face of the disc 4. The blades 7 overlap each other slightly, as shown in FIG. 2. Each blade 7 is pivoted to the casing body 1 about a respective pin 5 and it can be pivoted about the pin 5 by means of a knurled ring 8, the upper surface of which carries a plurality of pin members 9 engaged in notches 10 of U-shape, which are provided at the outer ends of the blades 7 remote from the inner points thereof.

In FIG. 2, the blades 7 are shown in full lines in their position in which the diaphragm completely covers the cell 6 and thus completely conceals the cell while FIG. 2 shows in broken lines a blade in a position corresponding of the completely open position of the diaphragm in which all the blades 7 are concealed beneath the dial 4.

As is well known, the digital display cell 6 comprises a central portion, as shown at 6*a*, containing a liquid crystal layer having a helical structure of 90° twist, two polarisers 6*b* and 6*c*, and a wall 6*d*, whose face towards the adjacent polariser 6*c* reflects visible light. The members 6*a*, 6*b* and 6*c* form a subassembly which may be referred to as means having a locally controllable opacity. This subassembly covers the reflecting wall 6d. In the embodiment shown in FIGS. 1 to 3, the components 6a to 6d form a rigid assembly. For that purpose, the assembly formed by the central portion 6a and the polarisers 6b and 6c is fixed to the reflecting wall 6d by means of a rectangular frame 11 of right-angled cross-section, which is itself fixed to the wall 6d. Thus, in the embodiment shown in FIGS. 1 to 3, the digital display cell 6 can be totally concealed by means of the diaphragm formed by the blades 7. The axis of the polarisers 6b and 6c are perpendicular to each other so that the cell 6 provides a display in a dark mode on a light background.

The iris diaphragm could be differently located, e.g. between the cell 6a, 6b, 6c and the reflecting wall 6d.

Figure 4:
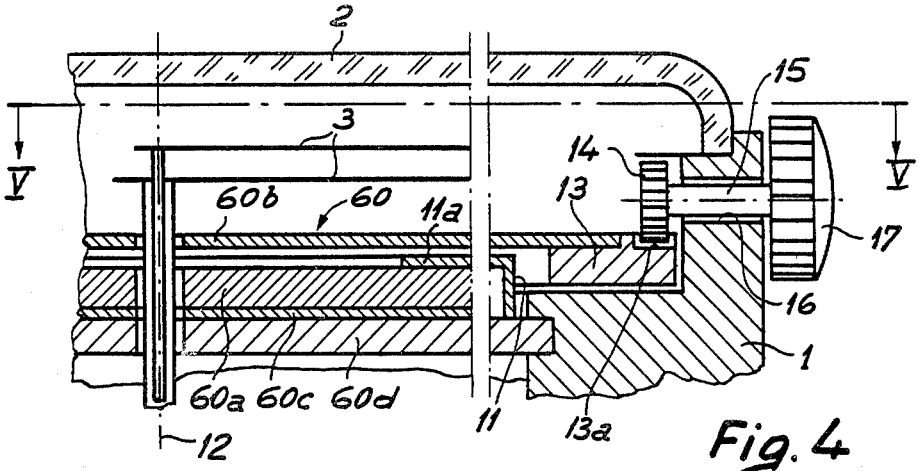
FIG. 4 is a view of part of two further embodiments of the invention, in elevation and vertical section.

FIG. 4, in which components that are identical or similar to those of FIG. 1 are denoted by the same reference numerals, illustrate two further embodiments using a digital display cell 60 which can be set by optical means selectively in a first state in which it presents the same colour as the dial surrounding it and in a second state in which it presents a colour different from that of said dial.

According to one embodiment, the cell 60 is of "twist nematic" type. According to another embodiment, the cell 60 is of the type described in the U.S. Pat. No. 3,551,026. This type is known as Heilmeiers's. In both of these two cases, the cell 60 comprises a central portion 60a containing a liquid crystal layer and two polarisers 60b and 60c disposed respectively at one side and at the other side of the central portion 60a. A reflecting wall 60d is disposed behind the lower polariser 60c. According to FIG. 4, only the central portion 60a and the lower polariser 60c are fixed to the support wall 60d by means of the fixing frame 11. The upper polariser 60d is mounted so as to be capable of rotary movement about an axis 12 which is perpendicular to the plane of the polariser and which coincides with the axis of rotary movement of the hands 3. For this purpose, the upper polariser 60d is fixed on a ring 13 which is centered on the axis 12 and which can rotate about the axis.

When the cell 60 is of "twist nematic" type the central portion 60a contains a layer of nematic liquid crystal having a helical structure of preferably a 90° twist as it is well known. If the cell is of Heilmeier's type, the central portion 60a comprises a layer of nematic liquid crystal containing dichroic or pleochroic molecules. In this case the upper polariser 60b plays no role in the displaying operation itself of the cell 60 but it constitutes only a means for giving to this cell, in response to one external action, the same colour as that of the dial surrounding the cell, as it will be explained hereafter.

A part of the upper surface of the ring 13 has a ring of face teeth 13a engaging with a pinion 14 keyed on a stem 15 whose axis is perpendicular to the axis 12. The stem 15 passes through the wall of the casing body 1 by way of a bore 16 therein, which forms a bearing. The outwardly projecting portion of the stem 15 carries a knurled operating button 17. As can be seen from FIG. 5, on its outside peripheral surface, the ring 13 has two notches or recesses 18 and 19 of unequal depth, which are disposed adjacent to each other. The arrangement also has a metal leaf spring 20 which at one end, is fixed by means of a screw 21 to the casing body 1 (not shown in FIG. 5). The end of the spring 20 which is remote from the fixing screw 21 is so shaped as to have a projecting portion 20a adapted to engage in one of the recesses 18 and 19, the projecting portion 20a being followed by a straight end portion 20b. The recesses 18 and 19 in the ring 13 are so positioned that, when the polarising plane of the upper polariser 60b is parallel to that of the lower polarising means 60c, the projecting portion 20a of the spring blade 20 is engaged in the recess 18 or the recess 19.

An electrical contact stud 22 is disposed at a fixed position adjacent the end portion 20b of the spring blade 20. The distance between the stud 22 and the outside peripheral surface of the ring 13 is such that the end portion 20b of the spring blade 20 is spaced from the stud 22 when the projecting portion 20a is engaged in the recess 18, while the end portion 20b of the spring blade bears against the stud 22 with suitable contact force when the projecting portion 20a is engaged into the recess 19.

When the projecting portion 20a is brought into line with the recess 19, this has the effect that the central portion 60a of the cell 60 is not activated, as will be described hereinafter with reference of FIG. 6.

Figure 5:
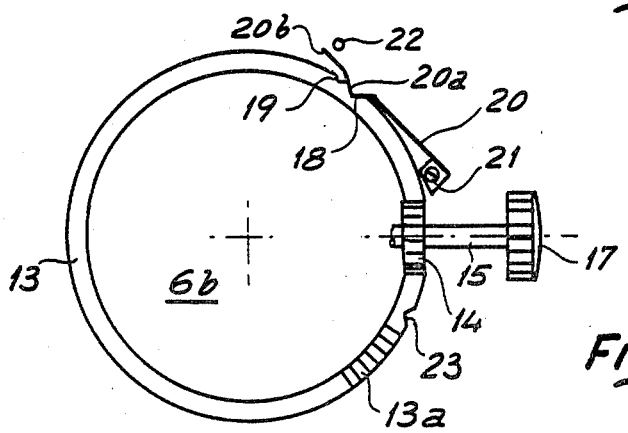
FIG. 5 is a diagrammatic plan view viewing from plane V—V in FIG. 4.

In contrast to the first-described embodiment, in the embodiments shown in FIGS. 4 and 5 the horizontal limb portion 11a of the fixing frame 11 forms the dial in front of which the hands 3 move. In the embodiment described, the dial 11a is dark in colour.

A third notch or recess 23 is provided in the periphery of the ring 13, substantially at 90° from the recesses 18 and 19. In addition, the depth of the recess 23 is so selected that, when the projecting portion 20a is engaged into the recess 23, the end portion 20b is not in contact with the stud 22.

Thus, if the cell 60 is of "twist nematic" type, when the projecting portion 20a is in line with the recess 18, the cell 60 provides a display in a light mode on a dark background and, when the projecting portion 20a is in line with the recess 23, the cell 60 provides a display in a dark mode on a light background. Since, in the embodiment considered herein, the dial 11a is dark in colour, the latter position of the ring 13 and therefore the polariser 60b is that in which the digital display cell 60 can be clearly seen.

Thus, by operating the button 17, the user of the watch will be able as desired to provide a display in a dark mode on a light background or a display in a light mode on a dark background (that is to say, partial concealment of the display cell 60), or total concealment of the display cell 60 when the projecting portion 20a is in line with the recess 19. If the cell 60 is of Heilmeier's type, when the projecting portion 20a engages the notch 18, the cell operates normally; but when this projecting portion 20a engages the notch 23 the cell appears uniformly dark and becomes invisible. In this case the means 19, 20b, 22 for interrupting the electrical power supply of the cell is useless and thus can be suppressed.

Figure 6:
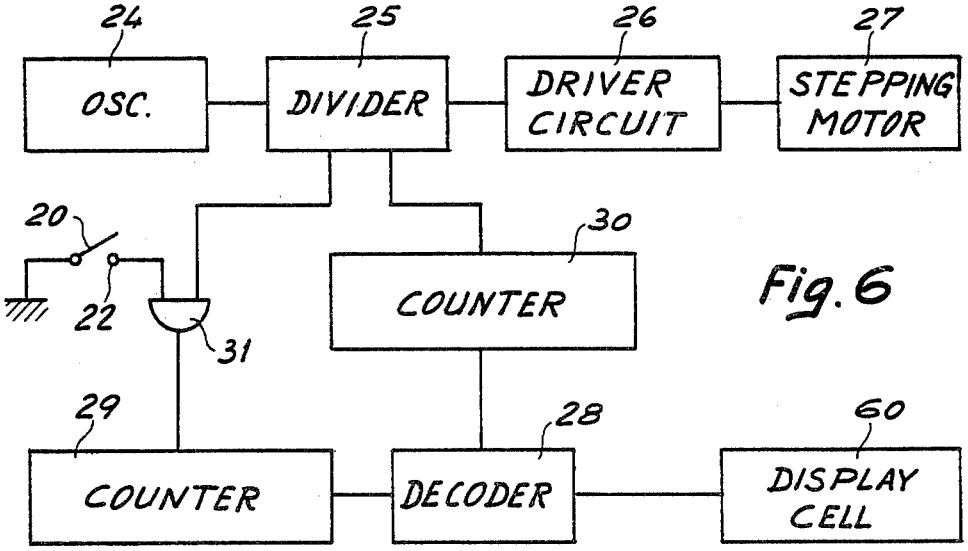
FIG. 6 is a functional diagram of the actuating circuits of the embodiments of the watch illustrated in FIGS. 4 and 5.

The system shown in FIG. 6 comprises a time base 24 such as a quartz oscillator producing a pulse signal which is processed in a divider 25. One of the outputs of the divider 25 is connected to a stepping motor 27 by way of a driver circuit 26. A second output of the divider 25 is connected to an input of a decoder 28 by wayof a first counter circuit 29. A second input of the decoder 28 is connected to a third output of the divider 25 by way of a second counter circuit 30. This second counter circuit is put in operation only in response to a suitable external action accomplished by the user of the watch. The decoder 28 controls the display cell 60 in dependence on the signals provided by the first counter circuit 29 and the second counter circuit 30. The connection between the divider 25 and the first counter circuit 29 is by way of an AND-gate 31, one input of which is connected to the divider 25, while the output is connected to the circuit 29. A second input of the AND-gate 31 is connected to the stud 22 described hereinbefore with reference to FIG. 5.

The mode of operation of the system shown in FIG. 6 is as follows. When the spring blade 20 is not in contact with the stud 22, the time data signal supplied by the divider 25 is applied to the first counter circuit 29 which, in response to that signal, supplies the decoder with a data signal. In response to the latter signal, the decoder supplies the display cell 60 with an actuating signal so that the cell display time data such as the hour and the minute.

If desired, upon special actuation by the user, the decoder can also supply the display cell 60, in response to a signal from the circuit 30, with a second actuating signal so that the cell 60 displays additional data such as the second, the day data, the month, etc.

When the user of the watch wants to efface the cell 60, he uses the button 17 to rotate the ring 13 so as to bring the projecting portion 20*a* of the blade 20 into the line with the recess 19. In this way, the end 20*b* of the blades 20 comes into contact with the stud 22, thereby earthing the second input of the AND-gate 31, the effect of which is to close the gate. The result of this is that no signal for controlling display of the time date time date reaches the display cell 60 which therefore appears entirely dark and merges with the dark colour of the dial-forming portion 11*a* which surrounds the cell.

Figure 7:
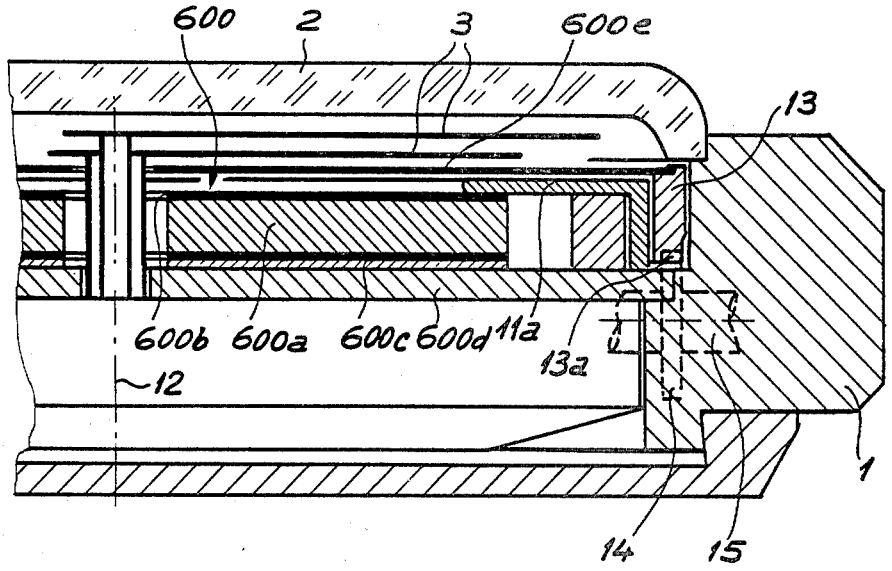
FIG. 7 is a view of part of a fourth embodiment of the invention, in vertical section.
Figure 8:
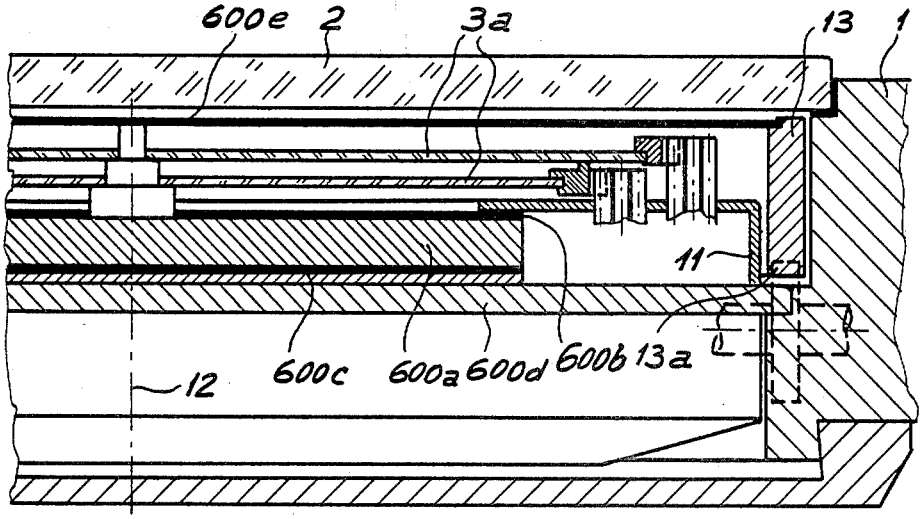
FIG. 8 is a view of part of a fifth embodiment of the invention, in vertical section.
Figure 9:
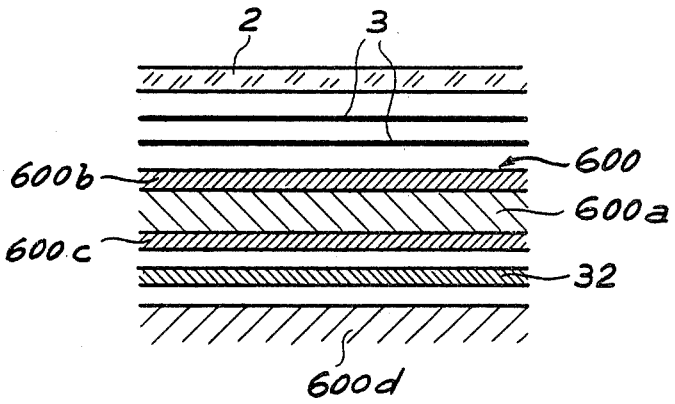
FIG. 9 is a diagrammatic view in vertical section of part of a sixth embodiment.

In FIGS. 7 to 9 which show other embodiments of the invention, components which are identical or similar to those shown in FIG. 4 are denoted by the same references.

The embodiment shown in FIGS. 7 to 9 uses a cell 600 which is of "twist nematic" type and its comprises parts 600*a*, 600*b*, 600*c* and 600*d* which play the same roles as those of the parts 6*a*, 6*b*, 6*c* and 6*d*, respectively of the cell 6 of FIG. 1. The components 600*a*, 600*b* and 600*c* are fixed with respect to each other. In the embodiments shown in FIGS. 7 and 8, the means for giving to the cell 600 in response of an external action, the same colour as that of the dial 11*a* is an additional polariser 600*e* which is disposed in the path of the light for reading the cell. The additional polariser 600*e* is so mounted that it can rotate about an axis 12 which is perpendicular to the plane thereof and which coincides with the axis of the hands 3 (embodiment of FIG. 7) or the discs 3*a* (the embodiment of FIG. 8) forming the analog display components of the watch. As in the embodiment shown in FIG. 4, the additional polariser 600*e* is fixed on a support ring 13 which is coaxial with the axis 12 and which can rotate therearound. The support ring 13 can be pivoted about the axis 12 by operating means which are identical or similar to the means 13*a* and 14 to 17 shown in FIG. 4.

The additional polariser 600*e* may be disposed at any position in the path of the light which will be reflected by the wall 600*d*. The polariser 600*e* may be positioned for example between the cell 600 and the hands 3, as shown in FIG. 7, or it may be positioned between the analog time display components (disc 3*a*) and the watch glass 2, as shown in FIG. 8.

In the embodiment shown in FIG. 9, the means used for giving to the cell in response to an external action, the same colour as that of the dial, is a quarter-wave plate 32 interposed between the lower polariser 600*c* and the reflective wall 600*d*. The quarter-wave plate 32 is mounted so as to be capable of rotating about an axis which is perpendicular to the plane thereof and which is coincident with the axis of rotation of the analog time display hands 3. The arrangement includes operating means which can be actuated by the user of the watch, for pivoting the quarter-wave plate 32 about its axis of rotation. The operating means which are not shown in FIG. 9 may be identical or similar to the means for controlling rotary movement of the polariser 60*b*, as shown in FIG. 4.

In normal operation, that is to say, when the user does not wish to make the digital time display invisible, the quarter-wave plate 32 is oriented in such a way that it does not cause any rotation of the plane of polarisation of the light passing through the plate 32 twice, or in such a way that the rotation of the polarisation plane is 180°. By pivoting the quarter-wave plate 32 through 45° from the normal operating position as referred to above, the result obtained is that the light, after having passed through the quarter-wave plate 32 twice, has a polarising plane which is angularly displaced through 90° with respect to the plane of polarisation of the light which leaves the lower polariser 600*c* and which is directed towards the quarter-wave plate 32. This second position of the quarter-wave plate 32 makes it possible to achieve complete effacement of the cell, and in this case there is no necessity to interrupt the electrical power supply of the cell 600.

Figure 10:
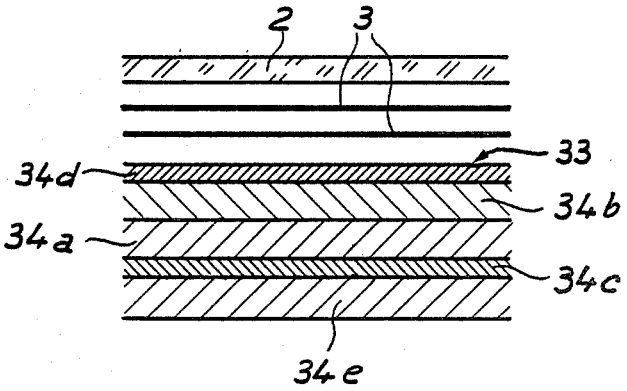
FIG. 10 is a diagrammatic view in vertical section of part of a seventh embodiment of a watch according to the invention.

The embodiment shown in FIG. 10 uses a digital display cell 33 comprising two superposed spirally-structured nematic liquid crystal layers 34*a* and 34*b* having each a twist angle of 90°. The two layers 34*a* and 34*b* are justaposed and the assembly 34*a* and 34*b* is positioned between two polarisers means 34*c* and 34*d*. The layer 34*b* is associated with an electrode and a counter-electrode, which cover the entire surface of the cell 33. The layer 34*a* is associated in displaying zones with electrodes and counter-electrodes as it is usual in a liquid crystal display cell. A reflecting wall 34*e* is provided behind the lower polariser 34*c*. If the polarisers 34*c* and 34*d* have their axes parallel to each other, and if the electrodes of the layer 34*b* are not activated, display of the cell 33 is in a dark mode on a light background. If, in contrast, the electrodes of the layer 34 are activated, the display is in a light mode on a dark background. The opposite effect is achieved if the polarisers 34*c* and 34*d* are oriented in such a way that their axes are orthogonal with respect to each other. It is possible for the display cell 33 to be rendered completely dark, if no electrode of the layer 34*a* is activated.

Figure 11:
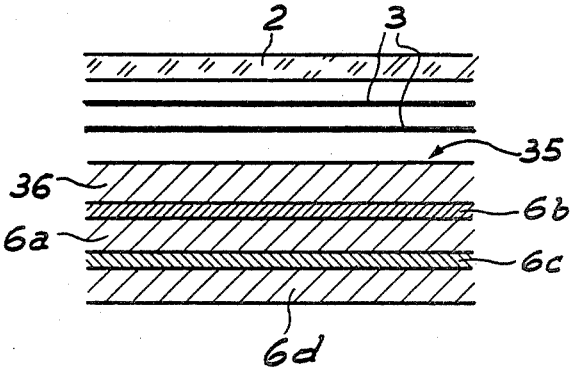
FIG. 11 is a diagrammatic view in vertical section of part of an eighth embodiment of a watch according to the invention.

The embodiment shown in FIG. 11 uses a digital display cell 35 which, as in the embodiment shown in FIG. 1, comprises a rigid assembly of components 6*a*, 6*b* and 6*c*.

However, the cell 35 further comprises a device 36 of uniformly controlled opacity, which extends over the entire surface area of the device 35. The device 36 may be disposed at any position in the path of the light for reading the display device 35. For example, as shown in FIG. 11, the device 36 may be positioned between the assembly 6*a*, 6*b*, 6*c* and the analog time display hands 3.

In a preferred embodiment, the device 36 comprises a layer of a nematic liquid crystal in which there are dichroic or pleochloric molecules in solution and, if appropriate, a suitable amount of a cholesteric compound, as is disclosed in U.S. Pat. No. 3,833,287. The colour of the dichroic molecules is the same as that of the dial 11*a*. The layer 36 is provided with an electrode and a counter-electrode, which extend over the entire surface area of the cell 35.

I claim:

1. A watch comprising a casing, movable members for displaying time analogically, dial means for said movable members, and digital display means surrounded by said dial means and responding to a first external action by taking substantially the same colour as that of said dial means and also responding to a second external action by taking a colour different from that of said dial means.

2. A watch according to claim 1, wherein said digital display means comprises a surface for reflecting incident light, means having a locally controllable opacity for covering said reflecting surface, opaque screen means having an upper surface which present the same colour as that of said dial means, and actuating means accessible from the outside of said casing for setting said screen means in a first position in which it is interposed in the path of said light and in a second position in which it is not interposed in said path.

3. A watch according to claim 2, wherein said screen means in said first position is located between said movable members and said means having a locally controllable opacity.

4. A watch according to claim 2, wherein said screen means in said first postion is located between the said reflecting surface and said means having a locally controllable opacity.

5. A watch according to claim 2, 3 or 4, wherein said screen means is an iris diaphragm.

6. A watch according to claim 1, wherein said digital display means comprises a surface for reflecting incident light, means having a locally controllable opacity for covering said reflecting surface, and a device of uniformly controllable opacity interposed in the path of said light.

7. A watch according to claim 6, wherein said device of uniformly controllable opacity comprises a nematic liquid crystal layer containing pleochroic molecules in solution, an electrode and a counter-electrode which are located at a respective side of said layer for covering substantially the entire surface of said device.

8. A watch according to claim 1, wherein said digital display means comprises a liquid crystal cell of Heilmeier's type provided with a surface for reflecting incident light, means having a locally controllable opacity for covering said reflecting surface, and a polariser interposed in the path of said light, and wherein said cell further comprises an additional polariser also interposed in said path and mounted in the watch for rotary movement about an axis perpendicular to the plane thereof, and actuating means accessible from the outside of the casing for effecting said rotary movement of said additional polariser.

9. A watch according to claim 1, wherein the digital display means comprises a liquid crystal cell of twist nematic type provided with a surface for reflecting incident light, means having a locally controllable opacity for covering said reflecting surface, and two polarisers which are interposed in the path of said light, one of said polarisers being mounted in the watch for rotary movement about an axis perpendicular to the plane thereof between a first position in which the background of the cell has the same colour as the dial around the cell and a second position in which the background of the cell has a colour different from that of said dial, and actuating means accessible from the outside of said casing for effecting said rotary movement of said one polariser.

10. A watch according to claim 9, wherein said actuating means are associated with means for interrupting the electrical power supply of the cell when the rotationally movable polariser is in said first position.

11. A watch according to claim 1, wherein said digital display means comprises a liquid crystal cell of twist nematic type provided with a surface for reflecting incident light, and means having a controllable opacity for covering said reflecting surface and comprising two polarisers interposed in the path of said light, and wherein said cell further comprises an additional polariser also interposed in said path and mounted in said watch for rotary movement about an axis perpendicular to the plane thereof, and actuating means accessible from the outside of said casing for effecting said rotary movement of said additional polariser.

12. A watch according to claim 1, wherein said digital display means comprises a liquid crystal cell provided with at least one liquid crystal layer, at least one polariser and a reflecting surface, and wherein said cell further comprises a quarter-wave plate interposed between said polariser and said reflecting surface, said quarter-wave plate being mounted for rotary movement about an axis perpendicular to the plane thereof, and actuating means accessible from the outside of said casing for effecting said rotary movement of said quarter-wave plate.

13. A watch according to claim 1, wherein the digital display means comprise a cell of twist nematic type having a spirally structured nematic liquid crystal layer and two polarisers each of them is located at one respective side of said layer, and wherein said cell further comprises a second spirally structured nematic liquid crystal layer, an electrode and a counter-electrode which are located at a respective side of said second layer, for covering substantially the entire surface of said cell, said second layer being disposed between the first layer and one of the polarisers.

* * * * *